US011204213B1

(12) United States Patent
Chen

(10) Patent No.: US 11,204,213 B1
(45) Date of Patent: Dec. 21, 2021

(54) FIREARM MAGAZINE LOADER

(71) Applicant: Sheng Chen, Ningbo (CN)

(72) Inventor: Sheng Chen, Ningbo (CN)

( * ) Notice: Subject to any disclaimer, the term of this patent is extended or adjusted under 35 U.S.C. 154(b) by 0 days.

(21) Appl. No.: 17/106,216

(22) Filed: Nov. 30, 2020

(30) Foreign Application Priority Data

Oct. 26, 2020 (CN) ..... 202022407402.7

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83
See application file for complete search history.

(56) References Cited

U.S. PATENT DOCUMENTS

| | | | | |
|---|---|---|---|---|
| 5,249,386 | A * | 10/1993 | Switzer | F41A 9/83 42/87 |
| 11,029,108 | B1 * | 6/2021 | Tai | F41A 9/84 |
| 2018/0058785 | A1 * | 3/2018 | Hefer | F41A 9/83 |
| 2018/0202735 | A1 * | 7/2018 | Draper | F41A 9/83 |
| 2018/0321004 | A1 * | 11/2018 | Fausti | F41A 9/67 |
| 2020/0182570 | A1 * | 6/2020 | Bian | F41A 9/83 |

* cited by examiner

*Primary Examiner* — J. Woodrow Eldred

(57) ABSTRACT

The present disclosure provides a firearm magazine loader. The firearm magazine loader includes an outer sleeve and an inner sleeve. The outer sleeve is movably connected with the inner sleeve. An inner surface of an inner side wall of the top opening of the inner sleeve is a non-slip surface. The non-slip surface prevents the guiding mechanism from bringing out bullet loaded in the interior of the inner sleeve when the inner sleeve is pushing out.

17 Claims, 6 Drawing Sheets

FIREARM MAGAZINE LOADER

TECHNICAL FIELD

The present disclosure relates to an auxiliary device for loading bullets into a magazine, and in particular to a firearm magazine loader.

BACKGROUND

A firearm magazine loader, also known as "bullet loader", "magazine speed loading device", "bullet loading device", etc., is used to assist a user to load bullets into a magazine. The firearm magazine loader is an auxiliary device that overcomes manual loading inefficiencies and prevent the user's hand joint and muscles from fatigue and even damage. Generally, the firearm magazine loader needs to have functions such as convenient blind operation (for example, suitable for loading bullets at night or in emergency), labor-saving installation, and quick loading.

At present, conventional firearm magazine loaders on the market are roughly divided into two types. One is a firearm magazine loader that uses a magazine loaded with multiple bullets to load multiple bullets at one time, which also comprises a bullet holder, a pushing rod, a sliding rail, and etc. For example, Chinese patent application with publication number CN109373805A, discloses a magazine speed loader, which comprises a shell, a bullet chamber disposed in the shell and extending along a length direction of the shell, and a magazine loading entrance located at one end of the shell and communicated with the bullet chamber. The bullet chamber comprises a slideable pushing rod pressing linearly arranged bullets into the magazine. The pushing rod extends out of a hole away from the magazine loading entrance of the bullet chamber. The hole is on the other end of the bullet chamber and is configured for the push rod to enter and exit. An opening loading bullets is on the shell corresponding to a top of the bullet chamber. A top cover openable covers the opening. A width of the bullet chamber is no more than a maximum diameter of the bullet, and a shape of a cross section of a bottom of the bullet chamber matches a shape of a bullet head. The firearm magazine loader is a device capable of pushing and loading bullets in batches at one time.

However, in some cases, such as loading bullets of sniper rifles, are not suitable for loading bullets in batches at one time, but it may still be necessary to quickly load bullets, which requires another firearm magazine loader that can load bullets individually and is simple to operate. This type of firearm magazine loader is realized through some exquisite designs of structures, and with help of some cooperative operations of hands. The bullets are loaded quickly and effortlessly after the user has mastered the usage of this type of firearm magazine loader. For example, Chinese patent with publication number CN206347921U, discloses magazine speed loader for a pistol, which comprises a loading base. The loading base comprises a magazine sliding cavity disposed inside. A lower portion of a front side of the holding base is hinged with a bullet pressing handle. A bullet pressing baffle is disposed in an upper portion of the bullet pressing handle. A separation spring is disposed between the front side of the loading base and the bullet pressing handle. When in use, the user holds the magazine speed loader with one hand and applies external forces from multiple directions to achieve rapid loading or removal of bullets from the magazine.

Chinese application with the publication number CN111006542A, discloses a bullet loading device including an inner sleeve and an outer sleeve movable with respect to the inner sleeve, which has solved technical problems of rapid reloading and labor-saving reloading. However, a guiding mechanism disposed on the inner sleeve may take out the loaded bullets during actual use, which reduces an efficiency of loading bullets. Moreover, there are also defects such as poor adaptability to magazines of different specifications and uncomfortable holding.

SUMMARY

Technical problems to be solved by the present disclosure is to provide a firearm magazine loader of which bullets are quickly and easily loaded and the loaded bullets are not easily taken out.

The present disclosure provides a firearm magazine loader. The firearm magazine loader comprises an outer sleeve and an inner sleeve. The outer sleeve is movably connected with the inner sleeve.

A guiding mechanism is installed on the outer sleeve. The guiding mechanism loads a bullet from a top opening of the inner sleeve into an interior of the inner sleeve. An inner surface of an inner side wall of the top opening of the inner sleeve is a non-slip surface. The non-slip surface prevents the guiding mechanism from bringing out bullet loaded in the interior of the inner sleeve when the inner sleeve is pushing out.

Furthermore, the inner surface of the inner side wall of the top opening of the inner sleeve extends along a horizontal direction and is substantially parallel to an axial direction of the bullet loaded in the interior of the inner sleeve.

Furthermore, the inner surface of the inner side wall of the top opening of the inner sleeve is a curved surface.

Furthermore, the guiding mechanism comprises a fixing base, a guiding arm, a rotating shaft, and a torsion spring. The rotating shaft passes through the torsion spring, the fixing base, and the guiding arm, so that the rotating shaft, the torsion spring, the fixing base, and the guiding arm are coaxially disposed. The fixing base is fixedly connected with the outer sleeve.

Furthermore, the guiding arm comprises an upper surface in contact with the bullet to be loaded. The upper surface of the guiding arm comprises a guiding groove with an arc-shaped cross section.

Furthermore, a radius of the arc-shaped cross section of the guiding groove is greater than 12.3 mm.

Furthermore, the outer sleeve is movably connected with the inner sleeve through a reset mechanism.

Furthermore, the reset mechanism comprises a sleeving tube fixedly connected with the outer sleeve, a column disposed in the sleeving tube, and a spring sleeved with the column. The spring is disposed in the sleeving tube.

Furthermore, a first end of the column is connected to a first end of the sleeving tube to prevent a first end of the spring from separating from the column. A second end of the spring abuts against a limiting portion disposed on the inner sleeve.

Furthermore, an outer surface of the outer sleeve comprises a gripping mechanism adapted to a shape of a hand to increase a gripping area.

Furthermore, the firearm magazine loader further comprises a bottom holding mechanism. The bottom holding mechanism is detachably connected to a bottom portion of the inner sleeve.

Furthermore, the firearm magazine loader further comprises a middle holding mechanism. The middle holding mechanism is disposed in the interior of the inner sleeve.

Furthermore, the middle holding mechanism comprises an installation groove disposed on a side wall of the inner sleeve and a reed. The installation groove is inclined. One end of the reed is insertable into the installation groove.

Furthermore, the inner surface of the inner side wall of the top opening of the inner sleeve comprises a slot substantially perpendicular to an axial direction of the bullet loaded in the interior of the inner sleeve or a bulge substantially perpendicular to an axial direction of the bullet loaded in the interior of the inner sleeve. The slot or the bulge is selected from an arc shape, a threaded shape or a corrugated shape Furthermore, rough particles or stripes are formed on the inner surface of the inner side wall of the top opening of the inner sleeve.

Furthermore, an anti-skid pad is fixedly disposed on the inner surface of the inner side wall of the top opening of the inner sleeve. The anti-skid pad is made of elastic silicone or rubber material.

Furthermore, side walls of two sides of the top opening of the inner sleeve extend upward and shrink upward to form an inner beam. An inner surface of the inner beam contacts outer surfaces of the bullet loaded in the interior of the inner sleeve.

Compared with the prior art, in the firearm magazine loader of the present disclosure, the loaded bullets are prevented from falling out or being carried out by the guiding arm by increasing contact areas between the loaded bullets and the firearm magazine loader to increase friction resistance, which improves loading efficiency. Further, by arrangements of the reasonable guiding mechanism, the reset mechanism, the holding mechanisms, etc., the resistance in a process of loading the bullet is minimized, and user satisfaction is improved.

DETAILED DESCRIPTION

Figure 1:
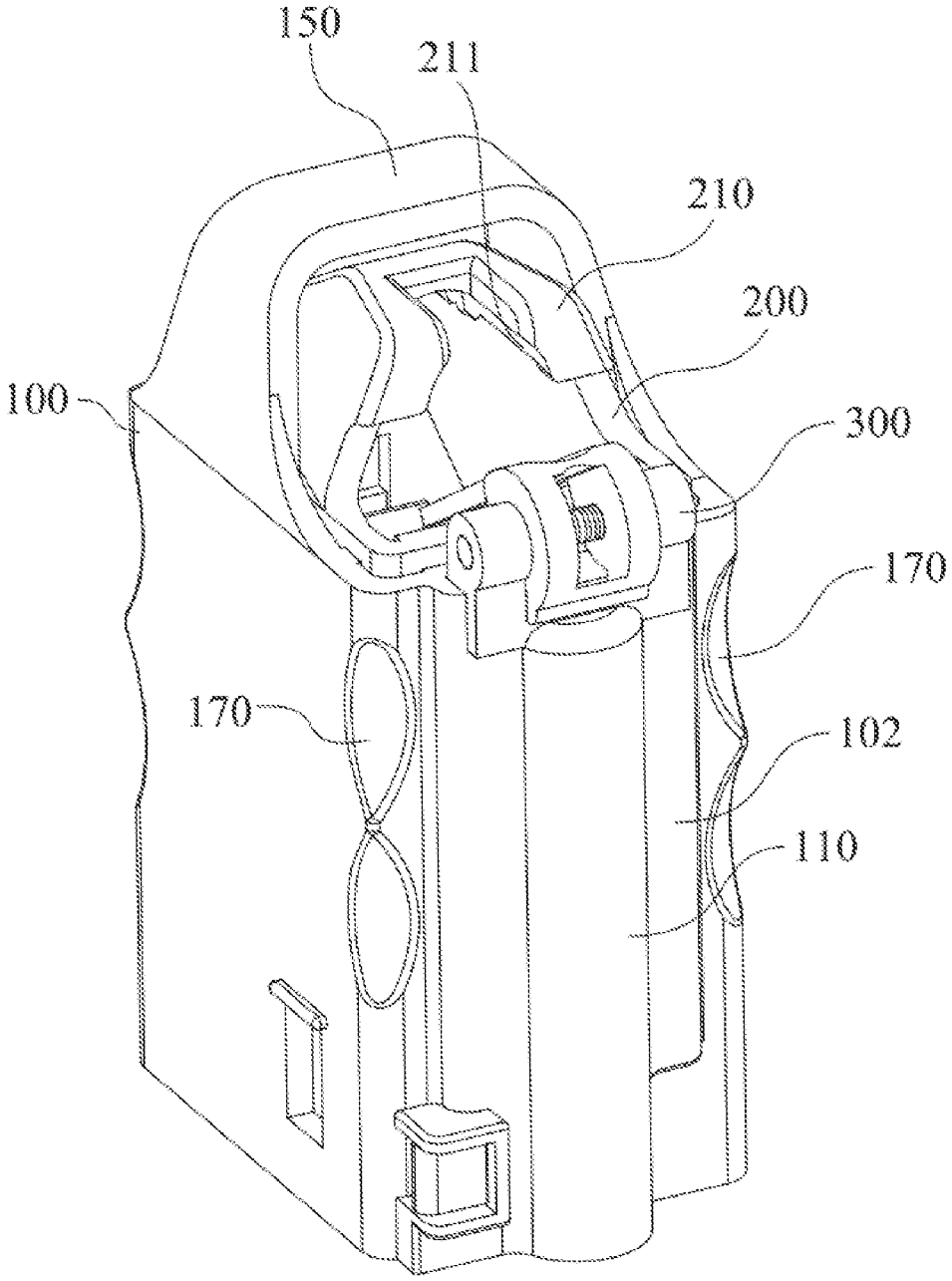
FIG. 1 is a schematic diagram showing an overall structure of a firearm magazine loader of the present disclosure.
Figure 2:
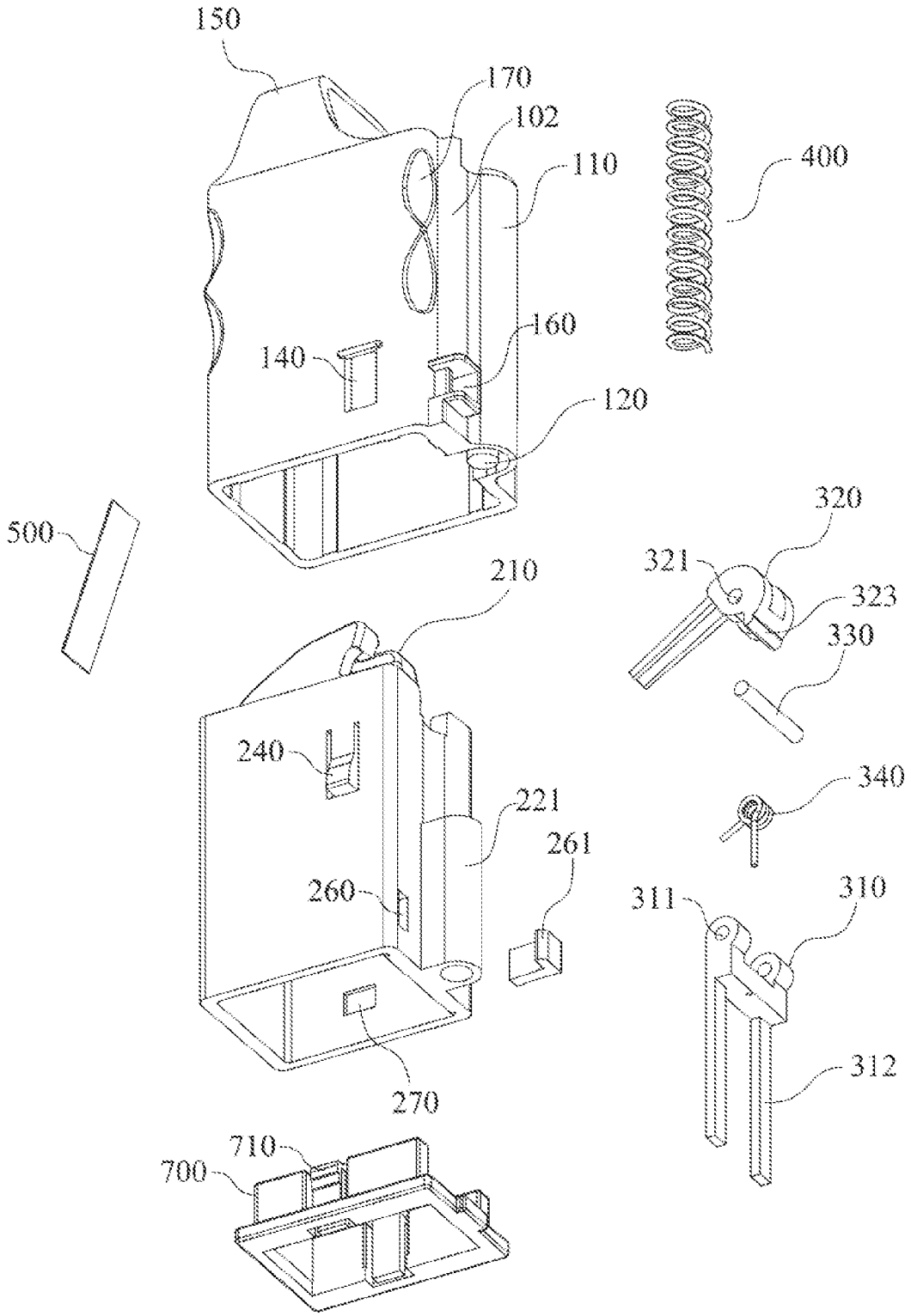
FIG. 2 is an exploded schematic diagram of the firearm magazine loader of the present disclosure.

The firearm magazine loader will be described in further detail below with reference to the embodiments and the drawings.

As shown in FIGS. 1-6, a firearm magazine loader of the present disclosure comprises an outer sleeve 100 and an inner sleeve 200. The outer sleeve 100 is movably connected with the inner sleeve 200. The inner sleeve 200 is configured to clamp a magazine that needs to be loaded with bullets or is configured to receive the magazine inside. During a loading process, a position of the inner sleeve 200 relative to the magazine remains basically unchanged. The outer sleeve 100 can be displaced relative to the inner sleeve 200. During displacement, one bullet is loaded into the magazine and then the outer sleeve 100 returns to an initial position (a position of the outer sleeve 100 before the bullet is loaded) to prepare for a next loading of another bullet.

The outer sleeve 100 is movably connected with the inner sleeve 200 through a reset mechanism. The reset mechanism is a mechanism that adopts elastic deformation to realize reset function. In one embodiment, the reset mechanism comprises a spring 400. A first end of the spring 400 is connected with the outer sleeve 100, and a second end of the spring 400 is connected with the inner sleeve 200. The spring 400 extends up and down, which is consistent with a direction in which the outer sleeve 100 moves up and down relative to the inner sleeve 200. In other embodiments, the reset mechanism may also be a gas spring, an elastic strip or other elastic components, which is not limited thereto.

In one embodiment, a sleeving tube 110 is fixedly connected with the outer sleeve 100. A column 120 is disposed in the sleeving tube 110. A first end of the column 120 is fixedly connected to the first end of the sleeving tube 110. The spring 400 is sleeved on the column 120 and is disposed between the column 120 and the sleeving tube 110. A minimum length H1 of the spring 400 that is compressed is less than a length H3 of the column 120. The first end of the column 120 is connected to the first end of the sleeving tube 110 to form a closed or semi-closed structure to prevent the spring 400 from separating from the first end of the column 120.

The inner sleeve 200 comprises a limiting portion. A second end of the spring abuts against the limiting portion disposed on the inner sleeve 200 to prevent the spring 400 from separating from the second end of the column 120. Compared with fixedly connected with the limiting portion, the spring 400 abuts against the limiting portion so that when the outer sleeve 100 has a largest axial distance to the inner sleeve 200, and the spring 400 does not exert an inward (axially close to the inner sleeve and the outer sleeve) tension on the inner sleeve 200 or the outer sleeve 100. That is, the outer sleeve 100 is only pushed by the spring 400 when it moves away from the inner sleeve 200. When the spring 400 returns to its natural length (or has not yet restored its natural length), the outer sleeve 100 or the inner sleeve 200 does not move outward (axially away from the inner sleeve or the outer sleeve) to form resistance.

Figure 3:
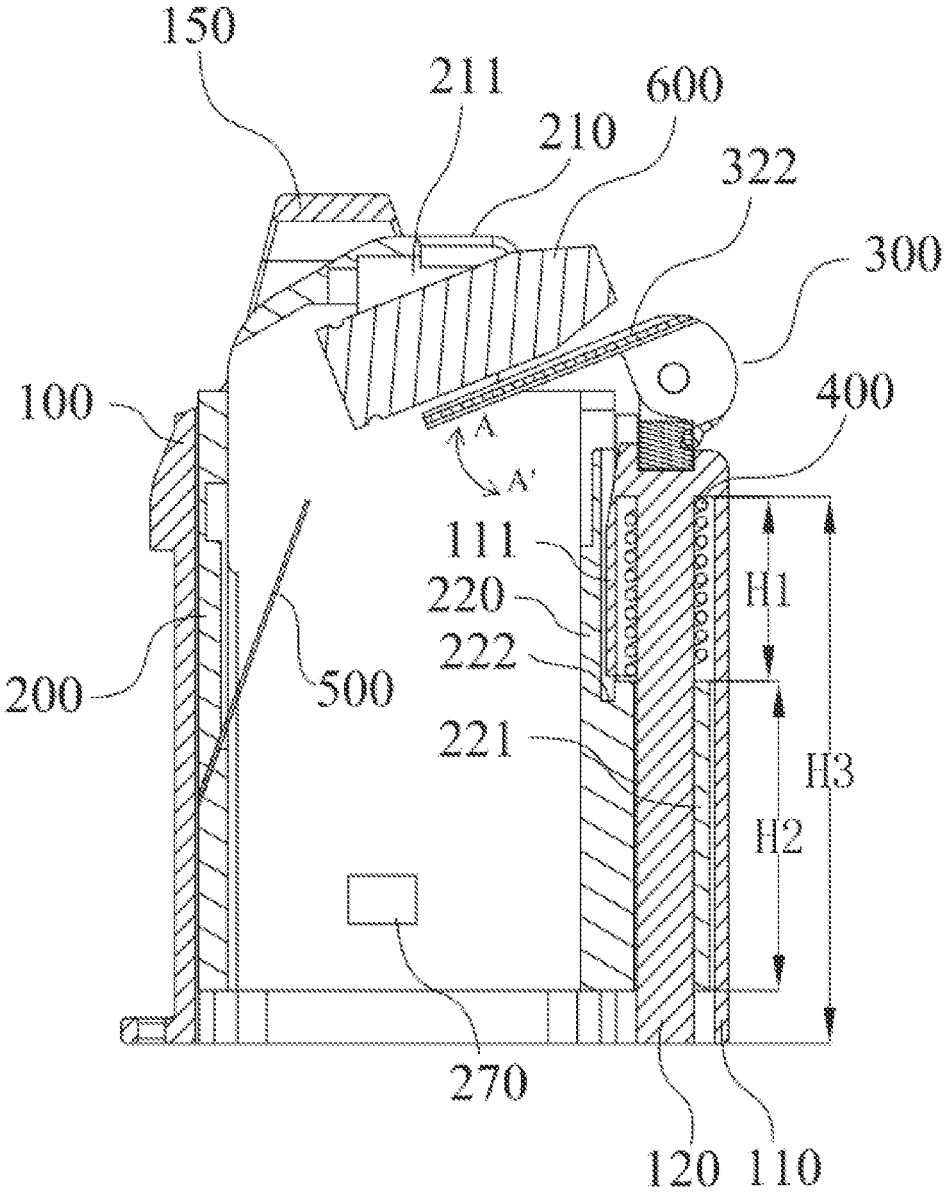
FIG. 3 is a cross-sectional view of the firearm magazine loader of the present disclosure.
Figure 4:
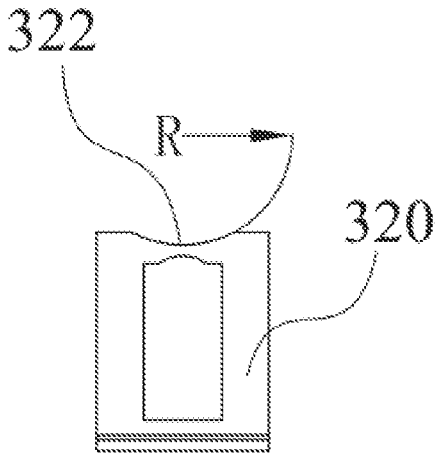
FIG. 4 is a schematic diagram showing a structure of a guiding arm of the firearm magazine loader of the present disclosure where R represents a radius of an arc-shaped guiding groove disposed on the guiding arm.
Figure 5:
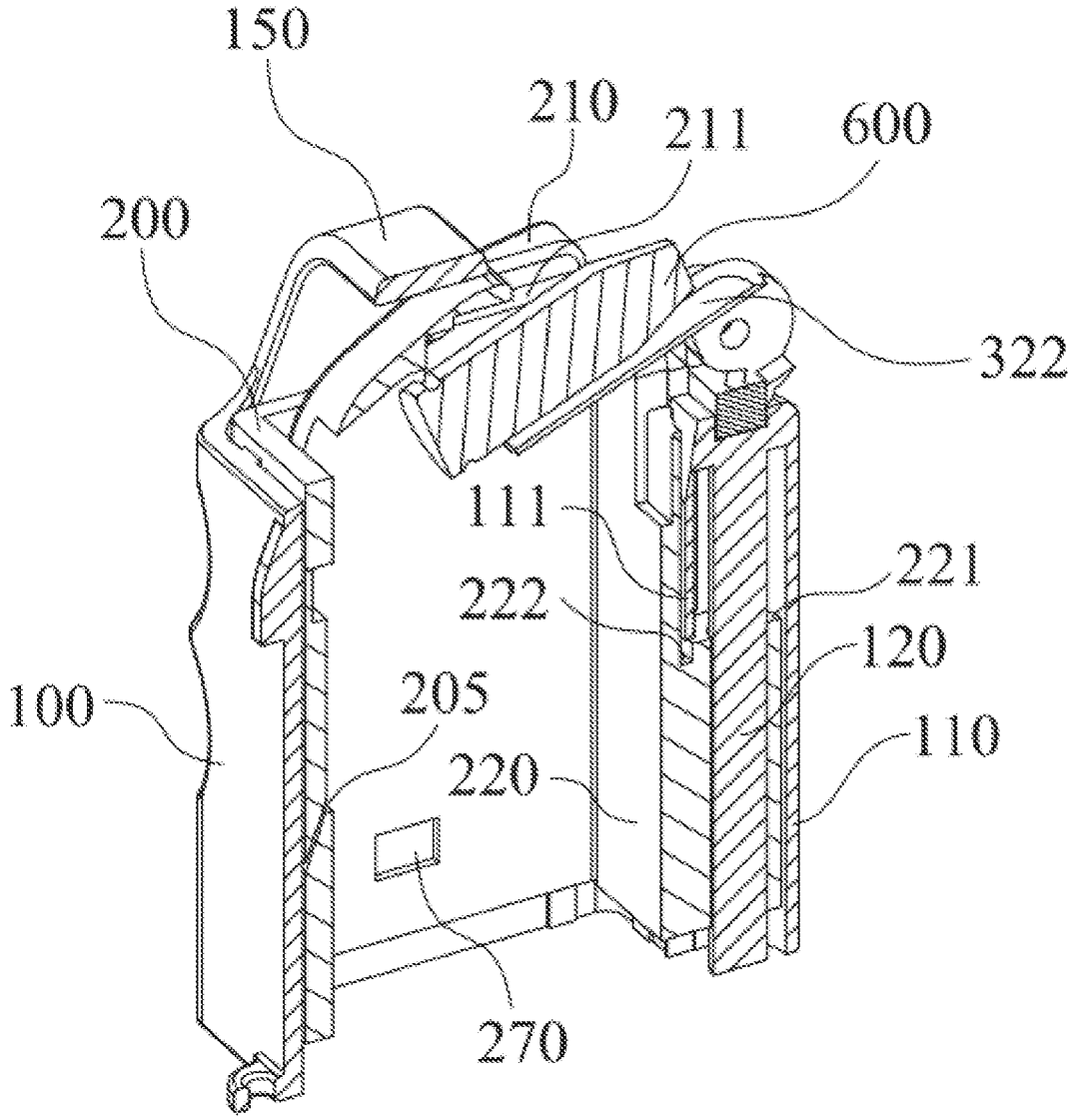
FIG. 5 is another cross-sectional view of the firearm magazine loader of the present disclosure where a reed is not shown.
Figure 6:
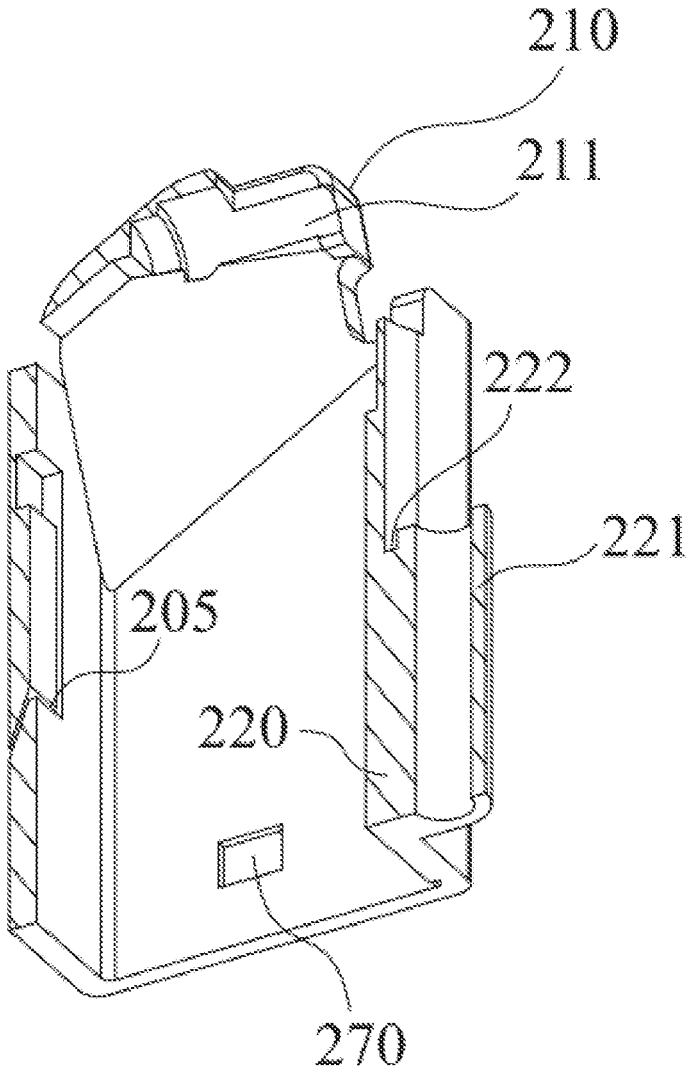
FIG. 6 is a cross-sectional view of the inner sleeve of the firearm magazine loader of the present disclosure where a reed is not shown.

In one embodiment, the limiting portion is a stop sleeving tube 221. The stop sleeving tube 221 is sleeved on the column 120 and is close to the second end of the column 120. As shown in FIG. 3, the stop sleeving tube 221 has a length H2 and the length H2 satisfies $H1+H2 \leq H3$. In some embodiments, the limiting portion may also be another blocking mechanism that does not generate or hardly generate friction with the column 120, That is, the blocking mechanism prevents the spring 400 from being separated from the second end of the column 120 and does not hinder the relative movement between the inner sleeve 200 and the outer sleeve 100.

A guiding mechanism 300 is installed on the outer sleeve 100. The guiding mechanism 300 comprises a fixing base 310, a guiding arm 320, a rotating shaft 330, and a torsion spring 340. The rotating shaft 330 passes through the torsion spring 340, connecting holes 311 of the fixing base 310, and holes 321 of the guiding arm 320, so that the rotating shaft 330, the torsion spring 640, the fixing base 310, and the guiding arm 320 are coaxially disposed. The fixing base 310 is fixedly connected with the outer sleeve 100. In one embodiment, the outer sleeve 100 comprises a plug sleeving tube 102 and the fixing base 310 comprises a plug column 312. The plug column 312 is inserted into the plug sleeving tube 102 to fixedly connected with the plug sleeving tube 102. In other embodiments, the fixing base 310 may also be connected to the outer sleeve 100 through other connecting structures, which will not be depicted thereto.

A side of the guiding arm 320 that is in contact with the bullet to be loaded is an upper surface of the guiding arm 320, and the other side is the bottom surface of the guiding arm 320. The upper surface of the guiding arm 320 comprises a guiding groove 322 with an arc-shaped cross section. A radius R of the arc-shaped cross section of the guiding groove 322 is greater than 12.3 mm, so as to adapt to bullets with various specifications to a maximum extent. One leg of the torsion spring 340 is inserted into the fixing base 310, and the other leg of the torsion spring 340 abuts against the bottom surface of the guiding arm 320.

The torsion spring 340 is configured to provide a restoring force for the guiding arm 320 after the bullet is loaded in to the inner sleeve 200. The guiding arm 320 also comprises a limiting block 323. The limiting block 323 cooperates with the torsion spring 340 to limit a maximum rotation angle of the guiding arm 320. On one hand, the guiding arm 320 plays a guiding role in a process of loading the bullet. On the other hand, after loading the bullet, the guiding mechanism 300 lifts up with the outer sleeve 100, and the loaded bullet is kept inside the inner sleeve 200. as shown in FIG. 3, the guiding arm 320 is subjected to lateral pressure of a bullet head and upward thrust of the outer sleeve 100. Under the combined force of the above two forces, the guiding arm 320 rotates along A-A' direction around the rotating shaft 330 to compress the torsion spring 34. At the moment when the guiding arm 320 is separated from a newly loaded bullet, the guiding arm 320 rotates around the rotating shaft 330 along the A'-A direction under action of the torsion spring 340 until it returns to the initial position, and the limiting block 323 is pressed against the fixing base 310. When another bullet needs to be loaded, the guiding arm 320 pushes the bullet to be loaded downwards while pressing the outer sleeve 100 down until enough space is left for a next bullet to be loaded.

In order to keep the inner sleeve 200 and the outer sleeve 100 stable during the relative movement of axial approach and distance, prevent misalignment or accidental separation of the inner sleeve 200 and the outer sleeve 100 due to imbalance of external force, and limit a minimum relative position between the outer sleeve 100 and the inner sleeve 200 on the axial direction, a minimum displacement limiting mechanism is disposed between the outer sleeve 100 and the inner sleeve 200.

The minimum displacement limiting mechanism comprises a limiting piece 111 disposed on the outer sleeve 100 and a limiting groove 222 disposed on the inner sleeve 200. The limiting piece 111 is inserted into and connected to the limiting groove 222 to limit the position of the outer sleeve 100 and the inner sleeve 200. In one embodiment, the limiting piece 111 is a portion of a side wall of the sleeving tube 110. The limiting groove 222 is located at a connection position of the stop sleeving tube 221 and a side wall 220 of the inner sleeve 200. When the limiting piece 111 is inserted into the limiting groove 222, the outer sleeve 100 is unable to continue to approach the inner sleeve 200.

In one embodiment, the firearm magazine loader further comprises a maximum displacement limiting mechanism. The outer sleeve 100 comprises a bayonet 140, and the inner sleeve 200 comprises a clamping block 240 disposed corresponding to the bayonet 140. When the clamping block 240 is locked into the bayonet 140, the relative displacement between the outer sleeve 100 and the inner sleeve 200 reaches a maximum value. That is, in the situation, an axial distance from the outer sleeve 100 to the inner sleeve 200 is the greatest and the outer sleeve 100 and the inner sleeve 200 does not separate from each other.

In addition, in one embodiment, the firearm magazine loader further comprises a locking mechanism. The locking mechanism comprises an outer locking hole 160 on the outer sleeve 100, an inner locking hole 260 on the inner sleeve 200, and a locking piece 261. The locking piece 261 passes through the outer locking hole 160 and the inner locking hole 260. The locking piece 261 comprises a blocking portion preventing the locking piece 261 from being completely inserted into an interior of the firearm magazine loader. When the locking piece 261 passes through the outer locking hole 160 and the inner locking hole 260, the inner sleeve 200 and the outer sleeve 100 are locked. When the locking piece 261 separates from, at least, the inner locking hole 260, the inner sleeve 200 and the outer sleeve 100 are unlocked. When the inner sleeve 200 and the outer sleeve 100 are in a locked state, a volume of the firearm magazine loader is the smallest, which is convenient for storage, packaging, and transportation.

A top opening of the inner sleeve 200 is configured to load the bullet. Side walls of two sides of the top opening of the inner sleeve 200 extend upward and shrink upward to form an inner beam 210. An inner surface of the inner beam 210 contacts an outer surface of the bullet 600 loaded in the interior of the inner sleeve 200. An inner surface 211 of the inner beam 210 is a non-slip surface, that is, the inner beam 210 prevents the guiding arm 320 from bringing out the loaded bullet 600 during a process of withdrawing from the inner sleeve 200 outward. In one embodiment, the inner surface 211 of the inner beam 210 is a curved surface, which fits the outer surface of the bullet 600 loaded as much as possible, such that a contact area between the inner surface 211 of the inner beam 210 and the outer surface of the bullet 600 is increased. Thus, the friction between the inner beam 210 and bullet 600 is increased and the loaded bullet 600 is prevented from being taken away from the magazine during a resetting process of the guiding arm 320.

The inner surface 211 of the inner beam 210 extends along a horizontal direction and is substantially parallel to an axial direction of the bullet loaded in the magazine, so as to further increase a contact area between the inner sleeve 200 and the outer surface of the loaded bullet 600. Further, when the bullet 600 is loaded, the bullet 600 moves inward along the guiding groove 322 on the upper surface of the guiding arm 320, and does not (hardly) contact the inner surface 211 of the inner beam 210, so no frictional resistance is formed during the loading of the bullet 600.

In one embodiment, the inner surface 211 of the inner beam 210 comprises a slot substantially perpendicular to an axial direction of the bullet loaded in the interior of the inner sleeve or a bulge substantially perpendicular to the axial direction of the bullet 600 loaded in the interior of the inner sleeve 200. The slot or the bulge is selected from an arc shape, a threaded shape or a corrugated shape The inner surface 211 of the inner beam 210 forms a discontinuous or intermittent contact surface with the outer surface of the bullet 600, and also plays a role in increasing friction. In other embodiments, rough particles, stripes or other structures that increases friction are formed on the inner surface 211 of the inner beam 210. For example, an anti-skid pad is fixedly disposed on the inner surface 211 of the inner beam 210. The anti-skid pad is made of elastic silicone or rubber material. The technical solutions in the above embodiments can be used in combination without conflict.

In order to adapt to different specifications and sizes of magazines, a bottom holding mechanism 700 is detachably connected to a bottom portion of the inner sleeve 200. By replacing different bottom holding mechanisms 700 with different side wall thicknesses, an inner diameter of a bottom opening of the inner sleeve 200 is reduced. The bottom holding mechanism 700 is detachably connected to the bottom portion of the inner sleeve 200. For example, in one embodiment, the bottom holding mechanism 700 comprises a connecting buckle 710 that is elastically deformable. The inner sleeve 200 comprises a connecting bayonet 270 connected with the connecting buckle 710 to achieve a detachable connection between the bottom holding mechanism 700 and the inner sleeve 200

In order to make the magazines of different specifications and sizes inserted into the inner sleeve 200 fit the inner sleeve 200 at the middle of the inner sleeve 200 as closely as possible, a middle holding mechanism is disposed in the interior of the inner sleeve 200. In one embodiment, the middle holding mechanism comprises an installation groove 205 disposed on the side wall of the inner sleeve 200 and a reed 500. The installation groove 205 is inclined. One end of the reed 500 is insertable into the installation groove 505.

When the magazine is inserted upwards into the inner sleeve 200, it squeezes one end of the reed 500 and receive pushing force from the other end of the reed 500, so that the magazine is held in the inner sleeve 200 stably. The middle holding mechanism may be any other elastic mechanism that can be triggered by insertion of the magazine, and will not be depicted herein, An outer surface of the outer sleeve 100 is a portion that a user holds. In order for the user to feel comfortable and not easy to slip off during use, the outer surface of the outer sleeve 100 comprises a gripping mechanism adapted to a shape of a hand to increase a gripping area. In one embodiment, the gripping mechanism comprises a concave surface 170 that fits finger pads. In one embodiment, the gripping mechanism further comprises an auxiliary beam 150 disposed on a top portion of the outer sleeve 100. When the bullet is loaded, the user's thumb presses the auxiliary beam 150, which improves stability of the grip.

Specifically, the firearm magazine loader of the present disclosure is suitable for different types of pistols, and is unable to be assembled on a rifle.

A working process of the firearm magazine loader of the present disclosure is: at first, the firearm magazine loader is in the locked state and the spring 400 is compressed. Then, the locking piece 261 is pulled out from the inner locking hole 260 or completely removed from the outer locking hole 160. The user holds the outer surface of the outer sleeve 100 and sleeves the firearm magazine loader from a top opening of the magazine to connect the firearm magazine loader and the magazine. At this state, the outer sleeve 100 and the inner sleeve 200 are in the initial positions. At this time, the spring 400 is still in a compressed state. After a first bullet is pushed obliquely downward along the guiding arm 320 from the top opening of the inner sleeve 200, the outer sleeve 100 is lifted upward by the elastic force provided by the spring 400. The guiding arm 320 rotates around the rotating shaft 330 while the guiding mechanism 300 and the outer sleeve 100 are lifted upward to move away from the inner sleeve 200 until the clamping block 240 is locked into the bayonet 140. At the moment, the relative displacement between the outer sleeve 100 and the inner sleeve 200 reaches the maximum value, and the guiding arm 320 is out of contact with the loaded bullet and reversely rotates around the rotating shaft 330 under the action of the torsion spring 340 to return to the original position, and the limiting block 323 is attached to the fixing base 10. When a second bullet needs to be loaded, the user holds the outer surface of the outer sleeve 100 and presses the outer sleeve 100, and further uses the thumb to press the auxiliary beam 150 to assist the loading of the second bullet until one end of the guiding arm 320 presses down the loaded first bullet to make room for the second bullet. The guiding arm 320 only moves axially and vertically during a pressing process without rotating. And then previous steps are repeated until the second bullet is loaded.

What is claimed is:

1. A firearm magazine loader, comprising an outer sleeve and an inner sleeve; wherein the outer sleeve is movably connected with the inner sleeve;

wherein a guiding mechanism is installed on the outer sleeve; the guiding mechanism loads a bullet from a top opening of the inner sleeve into an interior of the inner sleeve; an inner surface of an inner side wall of the top opening of the inner sleeve is a non-slip surface; the non-slip surface configured to prevent the guiding mechanism from bringing out the bullet loaded in the interior of the inner sleeve when the inner sleeve is pushing out.

2. The firearm magazine loader according to claim 1, wherein the inner surface of the inner side wall of the top opening of the inner sleeve extends along a horizontal direction and is substantially parallel to an axial direction of the bullet loaded in the interior of the inner sleeve.

3. The firearm magazine loader according to claim 1, wherein the inner surface of the inner side wall of the top opening of the inner sleeve is a curved surface.

4. The firearm magazine loader according to claim 1, wherein the guiding mechanism comprises a fixing base, a guiding arm, a rotating shaft, and a torsion spring; the rotating shaft passes through the torsion spring, the fixing base, and the guiding arm, so that the rotating shaft, the torsion spring, the fixing base, and the guiding arm are coaxially disposed; the fixing base is fixedly connected with the outer sleeve.

5. The firearm magazine loader according to claim 4, wherein the guiding arm comprises an upper surface in contact with the bullet to be loaded, and the upper surface of the guiding arm comprises a guiding groove with an arc-shaped cross section.

6. The firearm magazine loader according to claim 5, wherein a radius of the arc-shaped cross section of the guiding groove is greater than 12.3 mm.

7. The firearm magazine loader according to claim 1, wherein the outer sleeve is movably connected with the inner sleeve through a reset mechanism.

8. The firearm magazine loader according to claim 7, wherein the reset mechanism comprises a sleeving tube fixedly connected with the outer sleeve, a column disposed in the sleeving tube, and a spring sleeved with the column, wherein the spring is disposed in the sleeving tube.

9. The firearm magazine loader according to claim 8, wherein a first end of the column is connected to a first end of the sleeving tube to prevent a first end of the spring from separating from the column; a second end of the spring abuts against a limiting portion disposed on the inner sleeve.

10. The firearm magazine loader according to claim 1, wherein an outer surface of the outer sleeve comprises a gripping mechanism adapted to a shape of a hand to increase a gripping area.

11. The firearm magazine loader according to claim 3, wherein the firearm magazine loader further comprises a bottom holding mechanism; the bottom holding mechanism is detachably connected to a bottom portion of the inner sleeve.

12. The firearm magazine loader according to claim 3, wherein the firearm magazine loader further comprises a middle holding mechanism; the middle holding mechanism is disposed in the interior of the inner sleeve.

13. The firearm magazine loader according to claim 12, wherein the middle holding mechanism comprises an installation groove disposed on a side wall of the inner sleeve and a reed; the installation groove is inclined; one end of the reed is insertable into the installation groove.

14. The firearm magazine loader according to claim 3, wherein the inner surface of the inner side wall of the top opening of the inner sleeve comprises a slot substantially perpendicular to an axial direction of the bullet loaded in the interior of the inner sleeve or a bulge substantially perpendicular to the axial direction of the bullet loaded in the interior of the inner sleeve; the slot or the bulge is selected from an arc shape, a threaded shape or a corrugated shape.

15. The firearm magazine loader according to claim 3, wherein rough particles or stripes are formed on the inner surface of the inner side wall of the top opening of the inner sleeve.

16. The firearm magazine loader according to claim 15, wherein an anti-skid pad is fixedly disposed on the inner surface of the inner side wall of the top opening of the inner sleeve; the anti-skid pad is made of elastic silicone or rubber material.

17. The firearm magazine loader according to claim 3, wherein side walls of two sides of the top opening of the inner sleeve extend upward and shrink upward to form an inner beam; an inner surface of the inner beam contacts outer surfaces of the bullet loaded in the interior of the inner sleeve.

* * * * *